US006870113B2

(12) United States Patent
Dahl et al.

(10) Patent No.: US 6,870,113 B2
(45) Date of Patent: Mar. 22, 2005

(54) LATCHING MECHANISM FOR LOCKING A SPRING ENERGY STORE

(75) Inventors: Jörg-Uwe Dahl, Werder (DE); Ludvik Godesa, Berlin (DE); Ralph Hohenberger, Brieselang (DE); Marc Liebetruth, Glienicke (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/475,609

(22) PCT Filed: Mar. 26, 2002

(86) PCT No.: PCT/DE02/01156

§ 371 (c)(1),
(2), (4) Date: Mar. 31, 2004

(87) PCT Pub. No.: WO02/086926

PCT Pub. Date: Oct. 31, 2002

(65) Prior Publication Data

US 2004/0144629 A1 Jul. 29, 2004

(30) Foreign Application Priority Data

Apr. 23, 2001 (DE) ..... 101 20 783

(51) Int. Cl.[7] ..... H01H 1/52

(52) U.S. Cl. ..... 200/318; 200/327

(58) Field of Search ..... 200/400, 401, 200/318, 327, 320–325

(56) References Cited

U.S. PATENT DOCUMENTS

| | | | | | |
|---|---|---|---|---|---|
| 2,943,163 | A | * | 6/1960 | Hay | 200/50.21 |
| 3,773,995 | A | * | 11/1973 | Davies | 200/400 |
| 3,778,568 | A | * | 12/1973 | Wilson | 200/50.22 |
| 3,810,222 | A | * | 5/1974 | Nakagawa | 396/246 |
| 3,839,826 | A | * | 10/1974 | Ries | 49/139 |
| 4,141,165 | A | * | 2/1979 | Dichter et al. | 42/65 |
| 4,145,146 | A | * | 3/1979 | Ohkawara et al. | 400/614 |
| 4,209,676 | A | * | 6/1980 | Clausing | 200/50.21 |
| 4,429,556 | A | * | 2/1984 | Kambic | 70/149 |
| 4,443,676 | A | * | 4/1984 | Castonguay | 200/304 |
| 4,497,992 | A | | 2/1985 | Kodera et al. | |
| 4,885,444 | A | * | 12/1989 | Lazar et al. | 200/401 |
| 4,933,519 | A | * | 6/1990 | Milianowicz et al. | 218/22 |
| 5,711,110 | A | * | 1/1998 | Williams | 49/35 |
| 5,774,031 | A | * | 6/1998 | Linzenich et al. | 335/172 |
| 5,836,441 | A | * | 11/1998 | Scheel et al. | 200/17 R |
| 6,015,959 | A | * | 1/2000 | Slepian et al. | 200/400 |
| 6,184,483 | B1 | * | 2/2001 | Coudert et al. | 200/50.21 |

FOREIGN PATENT DOCUMENTS

| | | |
|---|---|---|
| DE | 3733916 | 10/1987 |
| DE | 4416088 | 4/1994 |
| DE | WO 2086926 | * 10/2002 |

* cited by examiner

*Primary Examiner*—Elvin Enad
*Assistant Examiner*—Lisa Klaus
(74) *Attorney, Agent, or Firm*—Harness, Dickey & Pierce P.L.C.

(57) ABSTRACT

A latching mechanism is for locking a spring energy store of an electric switching device. The store is tensioned by a rotary drive and an extensible lever system. In the latching mechanism, the extensible lever system is locked with the spring energy store under tension by way of a support element, an auxiliary lock and a primary lock, in addition to a stop that is allocated to the primary lock. The auxiliary lock can be pivoted by the extension of the lever system and the position of the primary lock during the pivoting of the auxiliary lock can be influenced by working surfaces that are allocated to one another. To configure the locking mechanism for pivoting the primary lock in a manner which obviates the use of a return spring that acts on said primary lock, the auxiliary lock and the primary lock respectively have at least two working surfaces. In a first pivoting phase of the auxiliary lock, the respective first surfaces of the two sets of working surfaces lie adjacent to one another and in a second pivoting phase of the auxiliary lock, the second working surfaces lie adjacent to one another, intermeshing in the manner of a toothed gear.

28 Claims, 7 Drawing Sheets

LATCHING MECHANISM FOR LOCKING A SPRING ENERGY STORE

This application is the national phase under 35 U.S.C. § 371 of PCT International Application No. PCT/DE02/01156 which has an International filing date of Mar. 26, 2002, which designated the United States of America and which claims priority on German Patent Application number DE 101 20 783.2 filed Apr. 23, 2001, the entire contents of which are hereby incorporated herein by reference.

FIELD OF THE INVENTION

The invention generally lies in the area of electrical switches. Preferably, it relates to switches equipped with a spring-powered drive for actuating contacts, and more preferably one to be used for the configuration of a latching mechanism for locking a spring energy store.

BACKGROUND OF THE INVENTION

In the case of a known latching mechanism for a spring-powered drive, in which the associated spring energy store is tensioned by use of a rotary drive and an extensible toggle lever system, the extensible toggle lever system is locked with the spring energy store under tension by a support element, an auxiliary lock and a primary lock in addition to a stop allocated to the primary lock. In the case of this latching mechanism, in which the supporting element designed as a lever is articulated on the one hand on the toggle joint of the toggle lever system and on the other hand on the auxiliary lock, the auxiliary lock can be pivoted by extension of the lever system.

In this case, the auxiliary lock and the primary lock have working surfaces allocated to one another, by which the position of the primary lock during the pivoting of the auxiliary lock can be influenced (DE 44 16 088 C1). In this case, a first working surface of the auxiliary lock is formed by a semicircular portion of the peripheral edge of the auxiliary lock which lies adjacent to a working surface of the primary lock designed as a roller, and keeps the primary lock in a first position counter to the force of the return spring allocated to it. In this first position, a half-shaft forming the stop is locked by the primary lock under spring pretension.

A second working surface, which is designed as a set-back edge and is likewise allocated to the roller, releases the primary lock at the end of the tensioning operation, so that on the one hand the primary lock pivots under the force of the return spring allocated to it in overtravel behind the half-shaft. On the other hand, the released half-shaft pivots on account of its spring pretension into the path of movement of the primary lock. Both pivoting operations must proceed before the primary lock pivots in the reverse direction by decoupling of the lever system from the rotary drive under the effect of the force of the spring energy store.

Since an indicating element for the state of the spring energy store is usually coupled to the primary lock, it is at the same time expedient with regard to the certainty of the indication that the primary lock pivots in overtravel behind the half-shaft only shortly before the decoupling of the lever system from the rotary drive. For this purpose, rapid movements of the latching mechanism are required, in particular when there is a high energy content of the spring energy store. In the case of the latching mechanism, the return spring allocated to the primary lock must therefore provide a correspondingly high returning force. This returning force is then in turn to be taken into account when configuring the latching mechanism with regard to its force reduction and when configuring the mechanisms providing the triggering force for releasing the locking.

SUMMARY OF THE INVENTION

To lock the tensioned spring energy store securely, it is necessary in particular for the tolerance range of the force under which the primary lock lies adjacent to the stop and the tolerance range of the force which is necessary for releasing the locking to be adapted to the tolerance range of the return spring. If there is a rupture of the return spring allocated to the primary lock, locking of the tensioned spring energy store is not possible.

On the basis of a latching mechanism, an embodiment of the invention is based on an object of configuring the latching mechanism for pivoting the primary lock in a manner which obviates the use of a return spring which acts on the primary lock.

According to an embodiment of the invention, an object may be achieved by the auxiliary lock and the primary lock respectively having at least two working surfaces. In a first pivoting phase of the auxiliary lock, respective first surfaces of the two sets of working surfaces lie adjacent to one another. Further, in a second pivoting phase, the second working surfaces lie adjacent to one another, intermeshing in the manner of a toothed gear.

On account of a configuration of this type, it is ensured that the primary lock is forcibly pivoted at the end of the tensioning operation to the extent that it reliably comes into adjacent contact with the stop under the effect of the force of the spring energy store when the lever system is decoupled from the rotary drive. Since, in particular when there is a high energy content of the spring energy store, no high returning forces have to be taken into account in the configuration of the latching mechanism, both a low tolerance range of the force under which the primary lock lies adjacent to the stop and a low tolerance range of the triggering force can be provided.

There is in fact a known latching mechanism for locking a spring energy store, in which a primary lock can be pivoted without using a return spring acting on the primary lock (DE 37 33 916 A1). In the case of this known latching mechanism, the primary lock is moved by an extensible lever system, without an auxiliary lock being interposed. It is thereby transferred in particular in overtravel behind a stop allocated to the primary lock.

An expedient development of the novel latching mechanism provides that on the one hand, the first working surface of the auxiliary lock is formed by a pin of the auxiliary lock protruding transversely with respect to the pivoting plane. Further, the second working surface of the auxiliary lock is formed by a concavely shaped portion of the peripheral edge of the auxiliary lock. On the other hand, the first working surface of the primary lock is formed by a lug of the primary lock and the second working surface is formed by a roller held on the primary lock.

In order when tensioning the spring energy store to transmit part of the force of the rotary drive and when detensioning the spring energy store to transmit part of the force of the spring energy store uniformly to the auxiliary lock in a space that is as small as possible, in a further refinement of an embodiment of the invention it is provided that, in the case of the locked position of the lever system, a roller which forms the supporting element and is arranged on a joint bolt of the lever system lies adjacent to a second concavely shaped portion of the peripheral edge of the auxiliary lock.

Furthermore, at the end of the tensioning phase, a small amount of travel which transmits from the rotary drive to the lever system can be converted into a large, and consequently abrupt, pivoting movement of the auxiliary lock. This can be done independently of the pivoting movement of the supporting element coupled to the lever system, if in a further refinement of an embodiment of the invention a driver coupled to the lever system and a two-armed pivotable control lever are provided for controlling the pivoting movement of the auxiliary lock, the first lever arm of the control lever protruding into an end portion of the path of movement of the driver and the second lever arm being allocated to a driving surface of the auxiliary lock. For controlling the auxiliary lock, in addition to the first driver and the control lever there may be provided a second driver, which is coupled to the lever system and during the extension of the lever system lies adjacent over a portion of its path of movement to a second driving surface of the auxiliary lock.

Maintaining a form of construction of the latching mechanism that is as small as possible is in this case made possible by the fact that the first driver is formed by the joint bolt of the lever system. The joint bolt can be allocated a lug-like projection of the control lever as its first lever arm. Further, there can be formed, on the second lever arm of the control lever, a pin which engages in a slot, which is formed close to the pivot point of the auxiliary lock and the inner edge of which forms the first driving surface. The second driver may be designed as a bolt which forms the toggle joint of a toggle lever connection coupled to the lever system, the second driving surface being formed by a further portion of the peripheral edge of the auxiliary lock.

BRIEF DESCRIPTION OF THE DRAWINGS

The present invention will become more fully understood from the detailed description of preferred embodiments, including an exemplary embodiment of the novel latching mechanism, given hereinbelow and the accompanying drawings, which are given by way of illustration only and thus are not limitative of the present invention, and wherein.

DETAILED DESCRIPTION OF THE PREFERRED EMBODIMENTS

Figure 1:
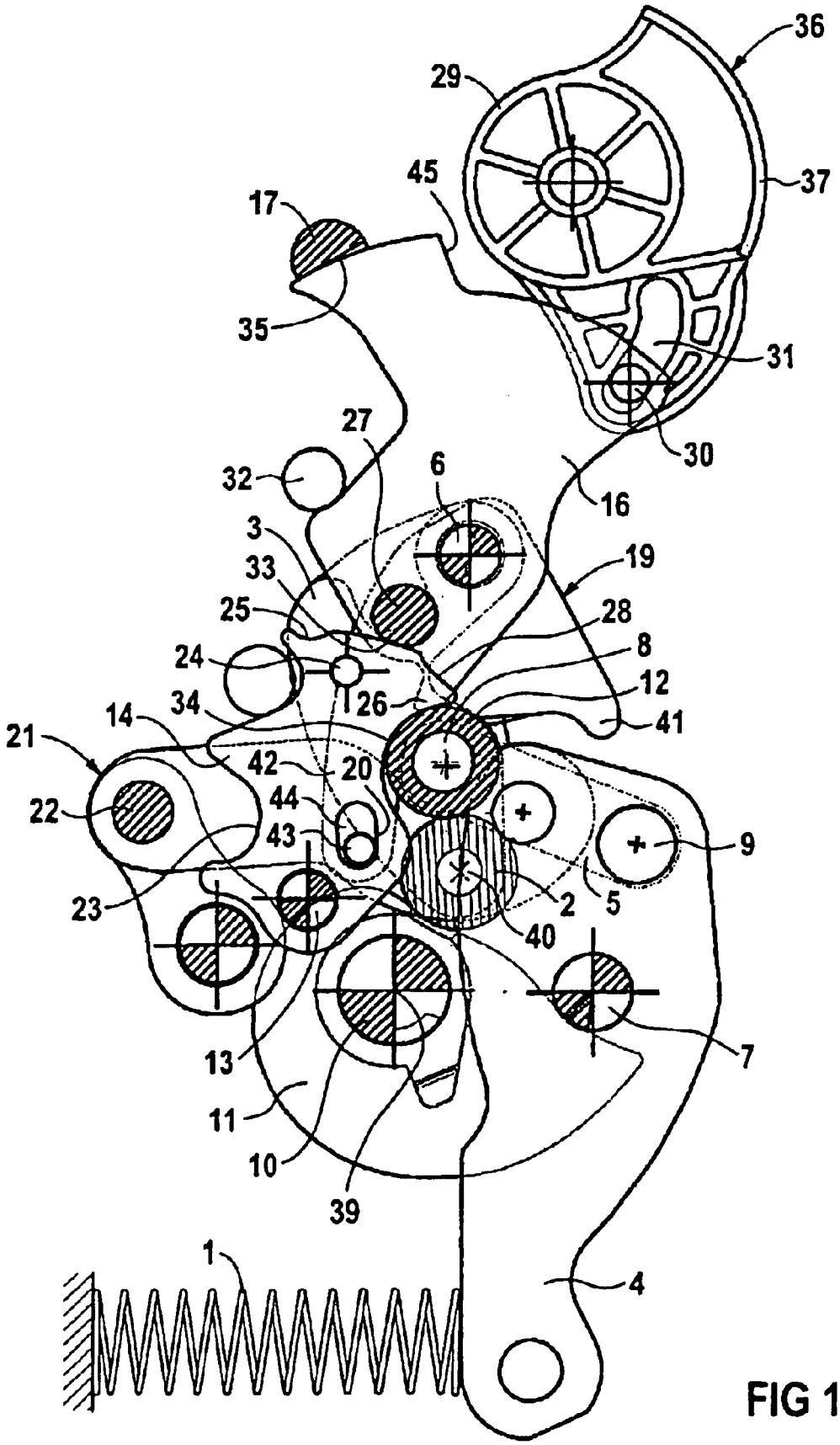
FIG. 1 shows the latching mechanism with the spring energy store fully relaxed.
Figure 2:
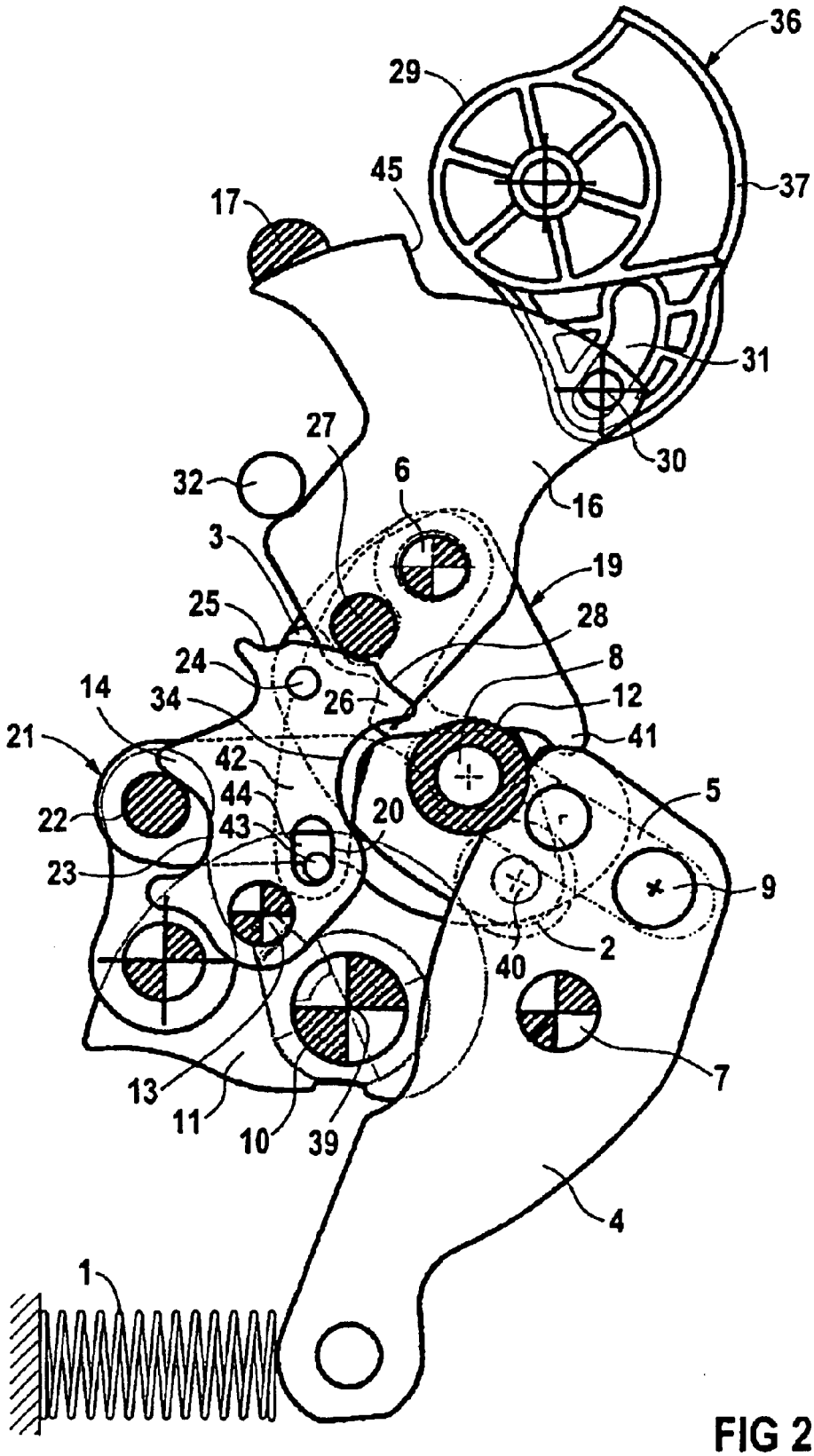
FIGS. 2 to 6 show the latching mechanism in five different phases of the tensioning process and FIG. 7 shows the latching mechanism with the spring energy store completely tensioned and locked.
Figure 3:
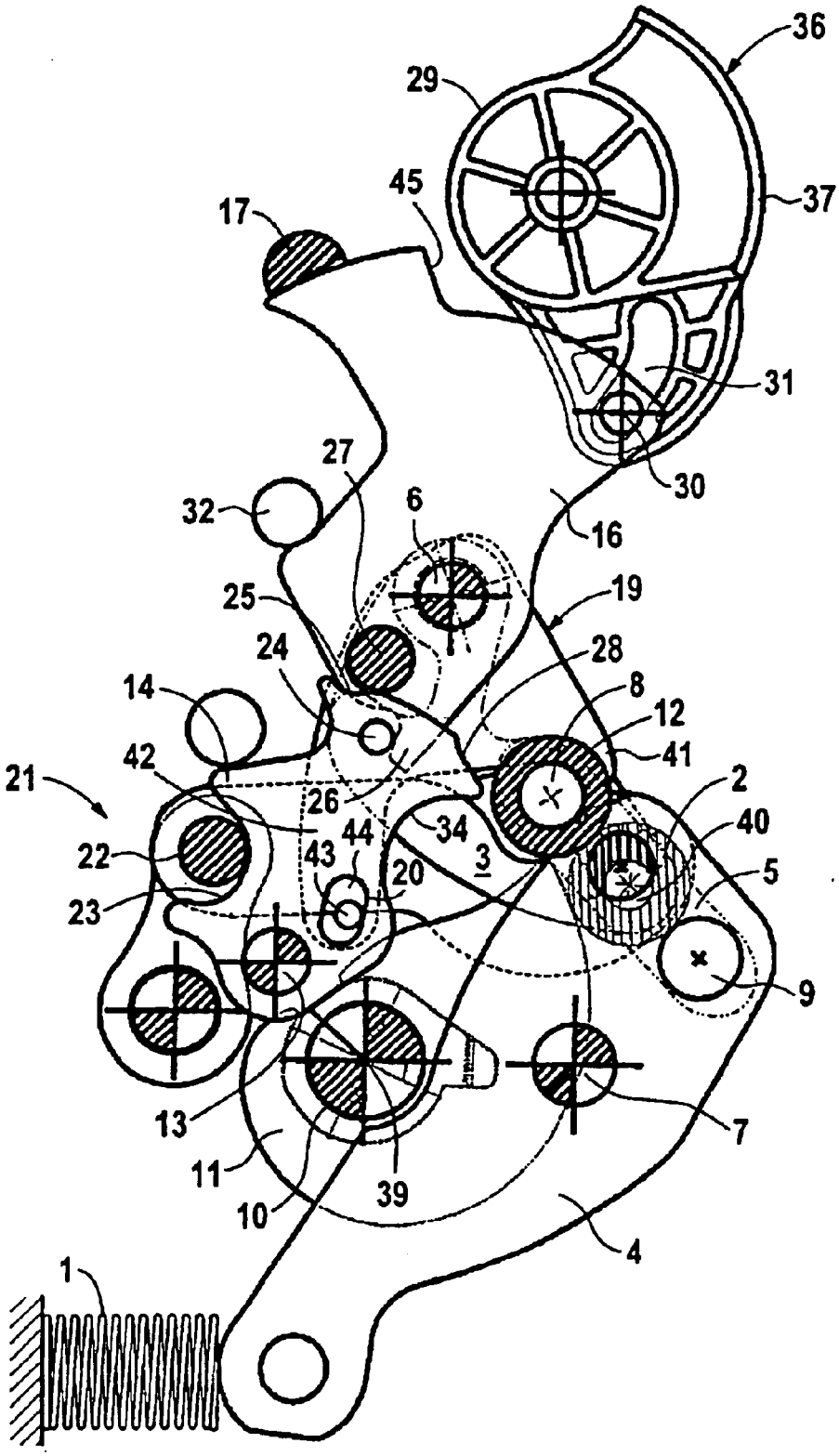
Figure 4:
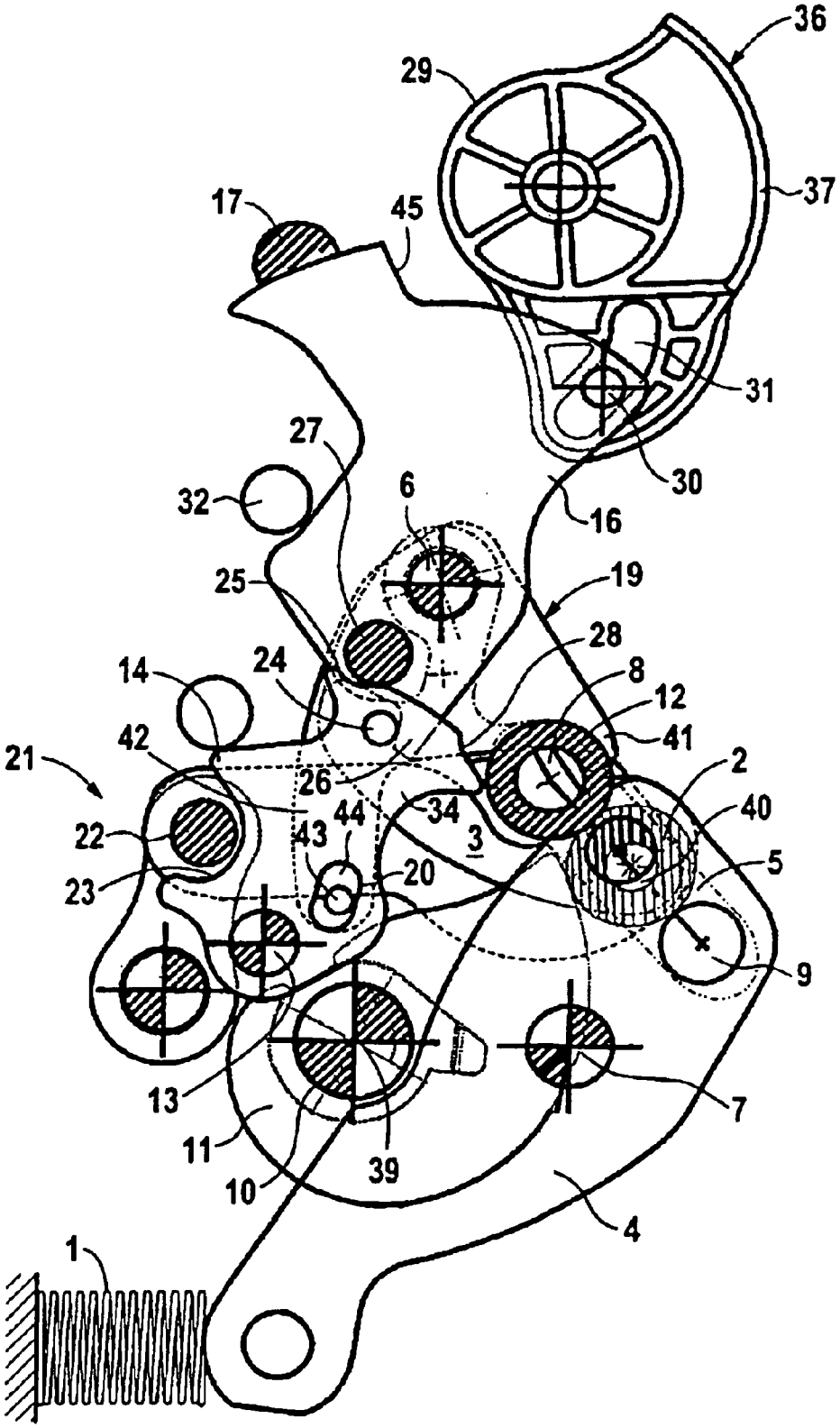

FIGS. 1 to 7 show a latching mechanism integrated into a drive device for a low-voltage circuit breaker. The drive device, which serves for the actuation of a switching contact arrangement not represented in the figures, has in this case a spring energy store 1, designed as a helical compression spring, for providing the actuating energy. Provided in the case of this drive device for tensioning the spring energy store 1 is a lever system which can be extended by way of a rotary drive and for the locking of which the latching mechanism serves.

The lever system is in this case formed by a roller lever 3 bearing a sensing roller 2, a tensioning lever 4 articulated on the spring energy store 1 and a coupling element 5 connecting the roller lever 3 to the tensioning lever 4. The roller lever 3 is pivotably arranged on a first bearing bolt 6 and the tensioning lever 4 is pivotably arranged on a second bearing bolt 7.

In this case, the roller lever 3 and the coupling element 5 are connected by means of a first joint bolt 8 and the tensioning lever 4 and the coupling element 5 are connected by a second joint bolt 9. The tensioning lever 4 is designed as a two-armed lever, the one arm being articulated on the coupling element 5 and the other arm being articulated on the spring energy store 1. Of the rotary drive, which may be operated for example by an electric motor and/or by a hand lever, only a tensioning shaft 10 which can rotate clockwise and a cam disk 11 which is fixedly arranged on the tensioning shaft 10 are respectively shown in FIGS. 1 to 7.

The cam disk 11 and the lever system 3, 4 and 5 are coupled for the transmission of the driving force of the rotary drive as soon as the sensing roller 2 borne by the roller lever 3 lies adjacent to the peripheral edge of the cam disk 11.

The latching mechanism has, on the one hand, for locking the lever system, a supporting element, which is designed as a roller 12, an auxiliary lock 14, which is pivotable about a third bearing bolt 13, a primary lock 16, which is pivotable about the first bearing bolt 6, and also a stop 17, which is allocated to the primary lock 16. On the other hand, for controlling the pivoting movement of the auxiliary lock 14, it includes a first driver, which is formed by the first joint bolt 8 of the lever system and acts via a two-armed control lever 19 on a first driving surface 20 of the auxiliary lock 14. It further includes a second driver 22, which forms the toggle joint of a toggle lever connection 21 coupled to the lever system and acts directly on a second driving surface 23 of the auxiliary lock 14.

To influence the pivoting movement of the primary lock 16 during the pivoting of the auxiliary lock 14, on the one hand a first working surface, formed by a pin 24, and a second working surface, formed by a first concavely shaped portion 25 of the auxiliary lock, are provided on the auxiliary lock 14. On the other hand, a first working surface, allocated to the pin 24 and formed by a lug 26 of the main lock, and a second working surface, allocated to the first concavely shaped portion 25 and formed by a roller 27 held on the primary lock, are provided on the primary lock 16. In this case, during the clockwise pivoting of the auxiliary lock 14 (i.e. under the effect of the force of the rotary drive 10 and 11), the primary lock 16 is turned counterclockwise as soon as firstly the pin 24 and the lug 26 and later, intermeshing in the manner of a toothed gear, the first concavely shaped portion 25 of the peripheral edge of the auxiliary lock and the roller 27 lie adjacent to one another.

The lever system 3, 4 and 5 is locked as soon as the roller 12 forming the supporting element and arranged on the first joint bolt 8 of the lever system lies adjacent to a second concavely shaped portion 28 of the peripheral edge of the auxiliary lock, the first concavely shaped portion 25 of the auxiliary lock lies adjacent to the roller 27 of the primary lock and the primary lock 16 lies adjacent to the stop 17 designed as a half-shaft. Coupled to the primary lock is an indicating element 29, which signals the state of the spring energy store. For this purpose, a pin 30 formed on the primary lock engages in a curved slot 31 of the indicating element 29 in such a way that, when the auxiliary lock 16 pivots, the indicating element pivots along with it.

FIG. 1 shows the latching mechanism before the beginning of the tensioning process. At this point in time, the cam disk 11 is in its starting position and the sensing roller 2 borne by the roller lever 3 lies adjacent to the peripheral edge of the cam disk 11. The lever system 3, 4 and 5 is in a first position, in which the spring energy store 1 is completely relaxed. In this case, the primary lock 16 is supported on a stop bolt 32, the auxiliary lock 14 is supported by way of a straight portion 33 of its peripheral edge adjacent to the roller 27 of the primary lock 16 on the primary lock 16, and the roller 12 coupled to the lever system 3, 4 and 5 and forming the supporting element is supported on a third concavely shaped portion 34 of the peripheral edge of the auxiliary lock.

A portion 35 of the peripheral edge of the primary lock 16 in this case lies underneath the half-shaft 17 in such a way that the half-shaft 17, which is rotatable by means of triggering mechanisms not represented any further against the force of a return spring likewise not represented, is held under spring pretension. The indicating element 29, which is coupled to the primary lock 16 and provided with an indicating surface 36, is in this case in a first position, in which a first subregion 39 of the indicating surface 36 of the indicating element lies opposite a viewing window not represented. This first subregion 37 signals that the spring energy store 1 is not completely tensioned. A symbol suitable for this is, for example, a compression spring shown relaxed. At the point in time represented in FIG. 1, neither does the first driver 18 lie adjacent to the control lever 19 nor does the second driver 22 lie adjacent to the second driving surface 23 of the auxiliary lock.

According to FIGS. 2 to 6, which show the latching mechanism during various phases of the tensioning process, the lever connection of the lever system formed by the roller lever 3 and the coupling element 5 is established by the bolt 40, bearing the sensing roller, and consequently also the roller lever 3, pivoting counterclockwise as the distance of the peripheral edge of the cam disk 11 from the pivot point 39 of the cam disk increases.

The movement of the roller lever 3 is transmitted by way of the coupling element 5 to the tensioning lever 4, so that the arm of the tensioning lever articulated on the spring energy store 1 is pivoted clockwise about the second bearing bolt 7 and the spring energy store 1 is thereby tensioned. At the point in time represented in FIG. 1, the second driver 22 comes into adjacent contact with the second driving surface 23 of the auxiliary lock and pivots the auxiliary lock 14 clockwise about the third bearing bolt 13 until, according to FIG. 3, the pin 24 which is formed on the auxiliary lock 14 and protrudes from the auxiliary lock perpendicularly with respect to the pivoting plane of the auxiliary lock runs against the lug 26 formed on the primary lock 16.

At this point in time, the first driver 20 runs against a first arm 41, protruding into an end portion of its path of movement and formed as a lug-like projection of the control lever, and pivots the control lever counterclockwise about its pivot point formed by the first bearing bolt 6. This pivoting movement is transmitted to the auxiliary lock via the second arm 42 of the control lever, which is made longer than the first arm. For this purpose, a control pin 43 protruding from the control lever transversely with respect to the pivoting direction of the control lever is arranged at the end of the longer, second arm 42 of the control lever 19. This control pin 43 protrudes into a second curved slot 44, which is formed close to the third bearing bolt 13 (pivot point of the auxiliary lock) and the inner edge of which forms the second driving surface of the auxiliary lock.

Since the distances of the working surfaces 24 and 25, formed on the auxiliary lock 14, from the pivot point of the auxiliary lock 13 are greater than the distance of the control pin 43 of the control lever from the pivot point of the auxiliary lock 13, and since furthermore the distances of the working surfaces of the primary lock 26 and 27 from the first bearing bolt 6 (pivot point of the primary lock) are less than the distance of a portion 45 of the peripheral edge of the auxiliary lock that is allocated to the stop 17 from the pivot point of the primary lock, according to FIGS. 3 to 6 at the end of the tensioning process a small arc length of the pivoting movement of the first driver 8 is converted into a large arc length of the pivoting movement of the portion 45 of the peripheral edge of the primary lock that is allocated to the stop. For this purpose, in a first pivoting phase according to FIGS. 3 and 4, the first working surfaces 24 and 26 of the auxiliary lock and of the primary lock respectively lie adjacent to one another.

Figure 5:
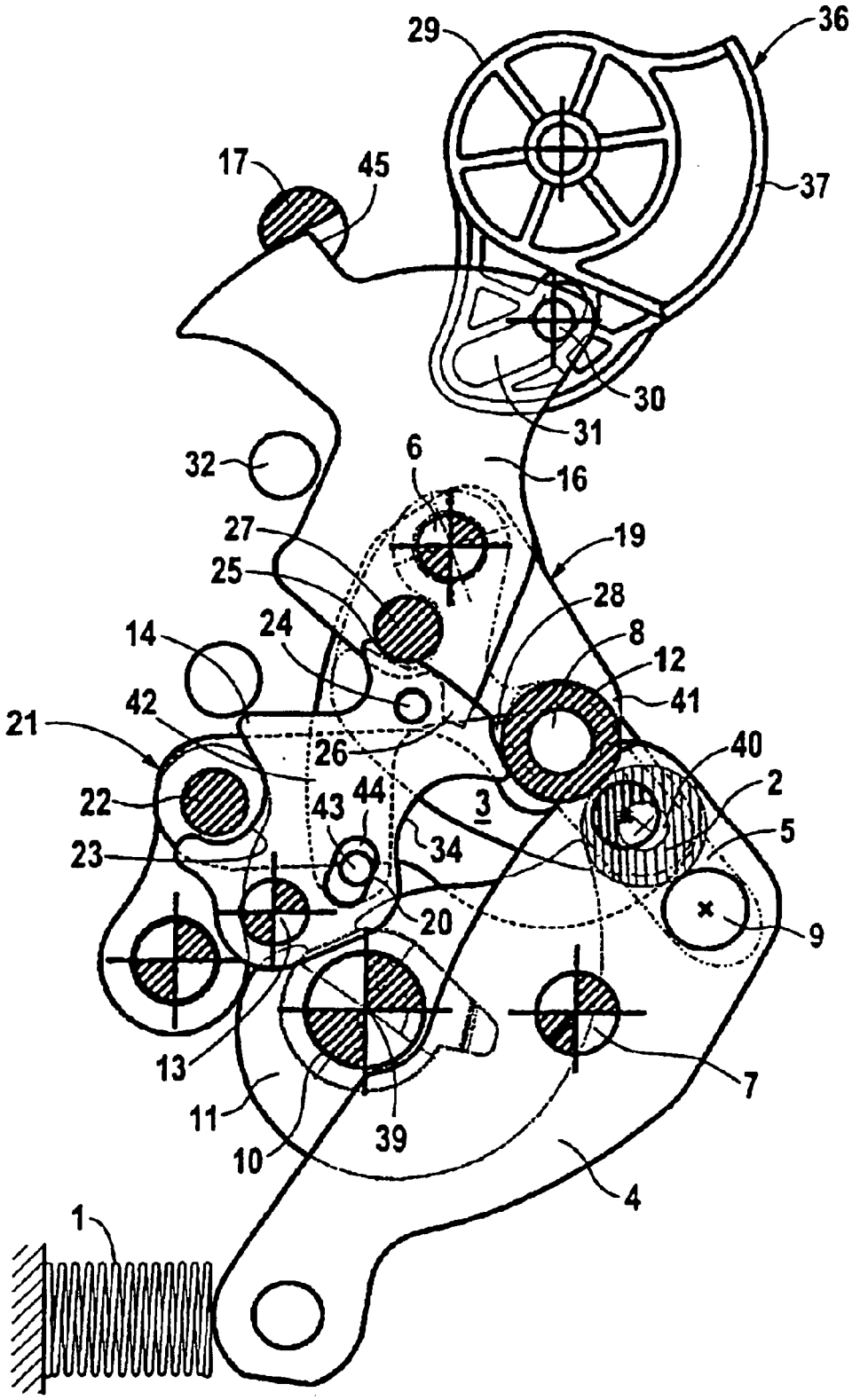
Figure 6:
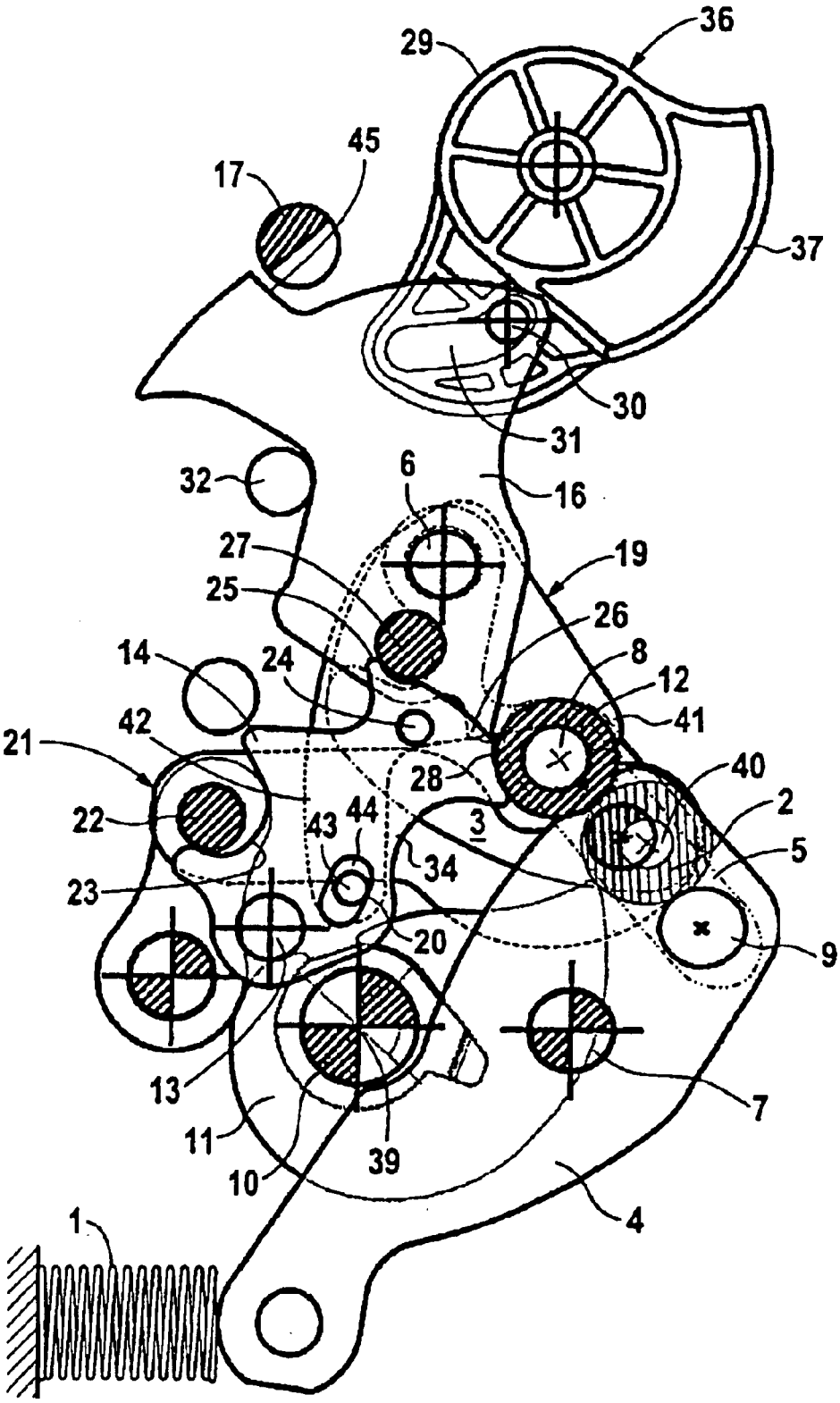

During the transition into a second pivoting phase of the auxiliary lock, in which according to FIGS. 5 and 6 the second working surfaces 25 and 27 lie adjacent to one another, intermeshing in the manner of a toothed gear, they are decoupled from one another. In this second pivoting phase of the auxiliary lock, the portion 45 of the peripheral edge of the primary lock that is allocated to the stop passes in overtravel behind the stop 17 shortly before the sensing roller 2 of the roller lever 3 is decoupled from the peripheral edge of the cam disk 11.

Figure 7:
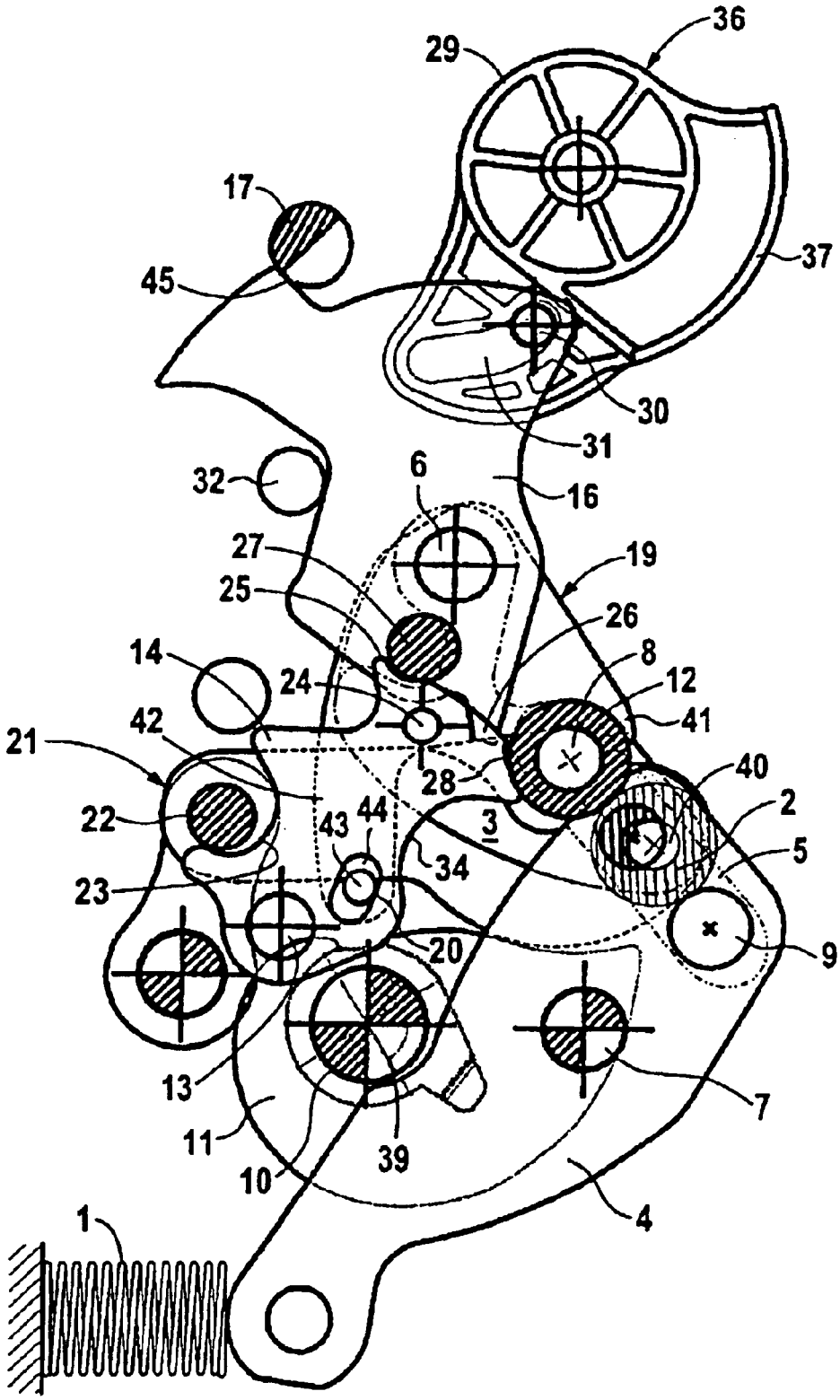

According to FIG. 7, which shows the latching mechanism with the spring energy store 1 completely tensioned and locked, the lever system, decoupled from the rotary drive, is supported under the force of the spring energy store 1 via the supporting element 12, coupled to the lever system, on the third concavely shaped portion 34 of the peripheral edge of the auxiliary lock, the rotary lock 14 is supported via the second working surfaces 25 and 27 on the primary lock 16 and the primary lock is supported on the stop 17. At this point in time, the indicating element 29, coupled to the primary lock, is in a second position, in which a second subregion 38 of the indicating surface 36 lies opposite the viewing window. This second subregion 38 signals that the spring energy store 1 is completely tensioned. A symbol suitable for this is, for example, a compression spring shown tensioned.

To keep the play between the mutually allocated working surfaces of the auxiliary lock and of the primary lock as small as possible, a spring acting on the primary lock may be provided, for example.

List of Designations

1 Spring energy store
2 Sensing roller
3 Roller lever
4 Tensioning lever
5 Coupling element
6 First bearing bolt (bearing bolt of the roller lever of the primary lock and of the two-armed control lever)
7 Second bearing bolt (bearing bolt or pivot point of the tensioning lever)
8 First joint bolt; forms the first driver
9 Second joint bolt (joint bolt between tensioning lever and coupling element)
10 Tensioning shaft
11 Cam disk
12 Roller which forms the supporting element
13 Third bearing bolt (bearing bolt or pivot point of the auxiliary lock)
14 Auxiliary lock
16 Primary lock
17 Stop
19 Two-armed control lever

20 First driving surface of the auxiliary lock
21 Toggle lever connection
22 Second driver
23 Second driving surface
24 Pin (first working surface of the auxiliary lock)
25 First concavely shaped portion of the peripheral edge of the auxiliary lock (second working surface of the auxiliary lock)
26 Lug of the primary lock (first working surface of the primary lock)
27 Roller held on the primary lock (second working surface of the roller)
28 Second concavely shaped portion of the peripheral edge of the auxiliary lock
29 Indicating element
30 First curved slot of the indicating element
32 Stop bolt
33 Straight portion of the peripheral edge of the auxiliary lock
34 Third concavely shaped portion of the peripheral edge of the auxiliary lock
35 Portion formed on the peripheral edge of the primary lock
36 Indicating surface of the indicating element
37 First subregion of the indicating surface
38 Second subregion of the indicating surface
39 Pivot point of the cam disk
40 Bolt which bears the sensing roller
41 First arm of the two-armed control lever
42 Second arm of the control lever
43 Control pin
44 Second curved slot, which is formed in the auxiliary lock
45 Portion of the peripheral edge of the primary lock that is allocated to the stop Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A latching mechanism for locking a spring energy store of an electrical switch, comprising:

an extensible lever system, locked with the spring energy store under tension by a support element, an auxiliary lock, and a primary lock, wherein a stop is allocated to the primary lock, wherein the auxiliary lock is adapted to be pivoted by extension of the lever system, wherein the auxiliary lock and the primary lock include working surfaces allocated to one another, by which the position of the primary lock during the pivoting of the auxiliary lock is adapted to be influenced, wherein the auxiliary lock and the primary lock respectively include at least two working surfaces, wherein, in a first pivoting phase of the auxiliary lock, respective first surfaces of the two sets of working surfaces lie adjacent to one another and wherein, in a second pivoting phase, the second working surfaces lie adjacent to one another, intermeshing in the manner of a toothed gear.

2. The latching mechanism as claimed in claim 1, wherein the first working surface of the auxiliary lock is formed by a pin of the auxiliary lock protruding transversely with respect to the pivoting plane and the second working surface of the auxiliary lock is formed by a concavely shaped portion of the peripheral edge of the auxiliary lock, and wherein the first working surface of the primary lock is formed by a lug of the primary lock and the second working surface is formed by a roller held on the primary lock.

3. The latching mechanism as claimed in claim 2, wherein, in the locked position of the lever system, a roller which forms the supporting element and is arranged on a joint bolt of the lever system, lies adjacent to a second concavely formed portion of the peripheral edge of the auxiliary lock.

4. The latching mechanism as claimed in claim 2, further comprising:

a driver, coupled to the lever system; and a two-armed pivotable control lever, the driver and two-armed pivotable control lever being adapted to control the pivoting movement of the auxiliary lock, wherein the first lever arm of the control lever protrudes into an end portion of the path of movement of the driver, the second lever arm being allocated to a driving surface of the auxiliary lock.

5. The latching mechanism as claimed in claim 4, further comprising:

a second driver, coupled to the lever system, wherein, during the extension of the lever system, the second lever lies adjacent over a portion of its path of movement to a second driving surface of the auxiliary lock, and is adapted to control the pivoting movement of the auxiliary lock.

6. The latching mechanism as claimed in claim 5, wherein the first driver is formed by the joint bolt of the lever system, the joint bolt being allocated a lug-like projection of the control lever as its first lever arm, and wherein a pin, formed on the second lever arm of the control lever, is adapted to engage in a slot formed close to the pivot point of the auxiliary lock and the inner edge of which forms the first driving surface.

7. The latching mechanism as claimed in claim 5, wherein the second driver is designed as a bolt which forms the toggle joint of a toggle lever connection coupled to the lever system and wherein the second driving surface is formed by a further portion of the peripheral edge of the auxiliary lock.

8. The latching mechanism as claimed in claim 1, wherein, in the locked position of the lever system, a roller which forms the supporting element and is arranged on a joint bolt of the lever system, lies adjacent to a second concavely formed portion of the peripheral edge of the auxiliary lock.

9. The latching mechanism as claimed in claim 8, further comprising:

a driver, coupled to the lever system; and a two-armed pivotable control lever, the driver and two-armed pivotable control lever being adapted to control the pivoting movement of the auxiliary lock, wherein the first lever arm of the control lever protrudes into an end portion of the path of movement of the driver, the second lever arm being allocated to a driving surface of the auxiliary lock.

10. The latching mechanism as claimed in claim 9, further comprsing:

a second driver, coupled to the lever system, wherein, during the extension of the lever system, the second lever lies adjacent over a portion of its path of movement to a second driving surface of the auxiliary lock, and is adapted to control the pivoting movement of the auxiliary lock.

11. The latching mechanism as claimed in claim 10, wherein the first driver is formed by the joint bolt of the lever system, the joint bolt being allocated a lug-like projection of the control lever as its first lever arm, and wherein a pin, formed on the second lever arm of the control lever, is adapted to engage in a slot formed close to the pivot point of the auxiliary lock and the inner edge of which forms the first driving surface.

12. The latching mechanism as claimed in claim 10, wherein the second driver is designed as a bolt which forms the toggle joint of a toggle lever connection coupled to the lever system and wherein the second driving surface is formed by a further portion of the peripheral edge of the auxiliary lock.

13. The latching mechanism as claimed in claim 1, further comprising:

a driver, coupled to the lever system; and a two-armed pivotable control lever, the driver and two-armed pivotable control lever being adapted to control the pivoting movement of the auxiliary lock, wherein the first lever arm of the control lever protrudes into an end portion of the path of movement of the driver, the second lever arm being allocated to a driving surface of the auxiliary lock.

14. The latching mechanism as claimed in claim 13, further comprising:

a second driver, coupled to the lever system, wherein, during the extension of the lever system, the second lever lies adjacent over a portion of its path of movement to a second driving surface of the auxiliary lock, and is adapted to control the pivoting movement of the auxiliary lock.

15. The latching mechanism as claimed in claim 14, wherein the second driver is designed as a bolt which forms the toggle joint of a toggle lever connection coupled to the lever system and wherein the second driving surface is formed by a further portion of the peripheral edge of the auxiliary lock.

16. The latching mechanism as claimed in claim 14, wherein the first driver is formed by the joint bolt of the lever system, the joint bolt being allocated a lug-like projection of the control lever as its first lever arm, and wherein a pin, formed on the second lever arm of the control lever, is adapted to engage in a slot formed close to the pivot point of the auxiliary lock and the inner edge of which forms the first driving surface.

17. The latching mechanism as claimed in claim 13, wherein the first driver is formed by the joint bolt of the lever system, the joint bolt being allocated a lug-like projection of the control lever as its first lever arm, and wherein a pin, formed on the second lever arm of the control lever, is adapted to engage in a slot formed close to the pivot point of the auxiliary lock and the inner edge of which forms the first driving surface.

18. The latching mechanism as claimed in claim 17, wherein the second driver is designed as a bolt which forms the toggle joint of a toggle lever connection coupled to the lever system and wherein the second driving surface is formed by a further portion of the peripheral edge of the auxiliary lock.

19. The latching mechanism as claimed in claim 1, further comprising:

a rotary drive.

20. A latching mechanism, comprising:

an extendible lever system, locked under tension by a at least an auxiliary lock and a primary lock, wherein the auxiliary lock is pivotable upon extension of the lever system, wherein the auxiliary lock and the primary lock respectively include at least two working surfaces, wherein, in a first pivoting phase of the auxiliary lock, respective first surfaces of the two sets of working surfaces lie adjacent to one another and wherein, in a second pivoting phase, the second working surfaces intermesh with one another.

21. The latching mechanism of claim 20, wherein the latching mechanism is for locking a spring energy store of an electrical switch.

22. An electrical switch comprising the latching mechanism of claim 20.

23. The electrical switch of claim 20, wherein the latching mechanism is for locking a spring energy store of the electrical switch.

24. An electrical switch, comprising:

a latching mechanism, the latching mechanism including, an extendible lever system, locked under tension by a at least an auxiliary lock and a primary lock, wherein the auxiliary lock is pivotable upon extension of the lever system, wherein the auxiliary lock and the primary lock respectively include at least two working surfaces, wherein, in a first pivoting phase of the auxiliary lock, respective first surfaces of the two sets of working surfaces lie adjacent to one another and wherein, in a second pivoting phase, the second working surfaces intermesh with one another.

25. The electrical switch of claim 24, wherein the latching mechanism is for locking a spring energy store of the electrical switch.

26. The electrical switch of claim 24, wherein the first working surface of the auxiliary lock is formed by a pin of the auxiliary lock protruding transversely with respect to the pivoting plane and the second working surface of the auxiliary lock is formed by a concavely shaped portion of the peripheral edge of the auxiliary lock, and wherein the first working surface of the primary lock is formed by a lug of the primary lock and the second working surface is formed by a roller held on the primary lock.

27. The electrical switch of claim 24, wherein, in the locked position of the lever system, a roller which forms the supporting element and is arranged on a joint bolt of the lever system, lies adjacent to a second concavely formed portion of the peripheral edge of the auxiliary lock.

28. The electrical switch of claim 24, wherein the latching mechanism further includes, a driver, coupled to the lever system; and a two-armed pivotable control lever, the driver and two-armed pivotable control lever being adapted to control the pivoting movement of the auxiliary lock, wherein the first lever arm of the control lever protrudes into an end portion of the path of movement of the driver, the second lever arm being allocated to a driving surface of the auxiliary lock.

* * * * *